US008897100B2

(12) United States Patent
Joo et al.

(10) Patent No.: US 8,897,100 B2
(45) Date of Patent: Nov. 25, 2014

(54) ELECTRONIC TIMER/SENSOR TO PROTECT SKIN FROM OVEREXPOSURE TO UV RADIATION

(75) Inventors: Shirley S. Joo, St. Louis, MO (US); Stacey Tull, Wildwood, MO (US); Saadia Raza, Chesterfield, MO (US)

(73) Assignee: Triple Threat Enterprises, LLC, Town & Country, MO (US)

( * ) Notice: Subject to any disclaimer, the term of this patent is extended or adjusted under 35 U.S.C. 154(b) by 62 days.

(21) Appl. No.: 13/149,314

(22) Filed: May 31, 2011

(65) Prior Publication Data

US 2012/0307600 A1 Dec. 6, 2012

(51) Int. Cl.
*G04F 1/00* (2006.01)
*G04F 3/06* (2006.01)

(52) U.S. Cl.
CPC ..... *G04F 3/06* (2013.01)
USPC ..... 368/109; 368/250

(58) Field of Classification Search
USPC ..... 368/107–109, 327, 244, 250–251
See application file for complete search history.

(56) References Cited

U.S. PATENT DOCUMENTS

| | | | | |
|---|---|---|---|---|
| 3,597,054 | A | 8/1971 | Winter | |
| 4,372,680 | A | 2/1983 | Adams | |
| 4,818,491 | A | 4/1989 | Fariss | |
| 4,985,632 | A | 1/1991 | Bianco | |
| 5,148,023 | A | 9/1992 | Hayashi | |
| 5,151,600 | A | 9/1992 | Black | |
| 5,365,068 | A | 11/1994 | Dickerson | |
| 5,382,986 | A | 1/1995 | Black | |
| 5,387,798 | A | 2/1995 | Funakoshi | |
| 5,461,366 | A | 10/1995 | Figuereo | |
| D376,547 | S | 12/1996 | McRae | |
| 5,581,090 | A | 12/1996 | Goudjil | |
| 5,686,727 | A | 11/1997 | Reenstra | |
| 5,992,996 | A | 11/1999 | Sawyer | |
| 6,348,694 | B1 | 2/2002 | Gershteyn | |
| D479,805 | S | 9/2003 | Tsai | |
| 6,817,192 | B2 * | 11/2004 | Ector et al. | 62/125 |
| 6,936,824 | B2 | 8/2005 | Takada | |
| 7,028,605 | B2 * | 4/2006 | Owen et al. | 99/344 |
| D528,933 | S | 9/2006 | Hunter | |
| 7,177,235 | B2 * | 2/2007 | Rund | 368/261 |
| 7,265,358 | B2 | 9/2007 | Fontaine | |
| 7,500,746 | B1 | 3/2009 | Howell | |
| 7,907,477 | B2 * | 3/2011 | Puzia | 368/10 |
| 8,077,552 | B1 * | 12/2011 | Pope et al. | 368/109 |
| 8,236,744 | B2 * | 8/2012 | Boyke et al. | 510/138 |
| 2004/0031927 | A1 | 2/2004 | Tsai | |
| 2005/0041534 | A1 * | 2/2005 | McCarthy | 368/109 |

(Continued)

OTHER PUBLICATIONS

Over Baked Pot Roast :: Cooks.com; Oct. 5, 2013.*

(Continued)

*Primary Examiner* — Sean Kayes
(74) *Attorney, Agent, or Firm* — Fredrikson & Byron, P.A.

(57) ABSTRACT

A portable device that alerts a user when she should reapply her sunscreen product. The device is activated by a start/stop button and a count down timer counts down from a fixed amount of time to zero. Once the timer has counted down to zero, an indicator such as an alarm is activated to notify the user it is time for her to reapply her sunscreen product. Preferably the fixed amount of time can range from about one to about four hours and, most preferably, the fixed amount of time is about two hours.

19 Claims, 4 Drawing Sheets

(56) References Cited

U.S. PATENT DOCUMENTS

| | | | | |
|---|---|---|---|---|
| 2005/0190655 | A1* | 9/2005 | Blumberg | 368/73 |
| 2006/0067896 | A1 | 3/2006 | Schaffer | |
| 2006/0227669 | A1* | 10/2006 | Pennaz et al. | 368/327 |
| 2008/0265170 | A1 | 10/2008 | Ales | |
| 2009/0040874 | A1* | 2/2009 | Rooney et al. | 368/10 |
| 2010/0044253 | A1 | 2/2010 | Santalucia | |
| 2011/0218765 | A1* | 9/2011 | Rogers | 702/176 |
| 2011/0280107 | A1* | 11/2011 | Day | 368/10 |

OTHER PUBLICATIONS aad.org/media-resources/stats-and-facts/prevention-and-care/sun-screens, 5 pages, accessed online Sep. 6, 2011.

skincancer.org/the-sefs-guide-to-sunscreens.html, 8 pages, accessed online Sep. 6, 2011.

msnbc.msn.com/id/28796417/ns/health-skinandbeauty, accessed online Sep. 6, 2011.

itunes.apple.com/us/app/sun-alert/id324267089?mt-8, 3 pages, accessed online Feb. 17, 2011.

skincareguidelines.com/skin-care/chaney-instrument-uv-skincare-sensor, accessed online Mar. 3, 2011.

getyourskinbetter.com/chaney-instrument-00913-uv-skincare/sensor, accessed online Mar. 3, 2011.

amazon.com/chaney-instrument-uv-skincare-sensor/dp/B000A31N1K, accessed online Mar. 3, 2011.

International Search Report and Written Opinion, dated Sep. 21, 2012 for PCT Application No. PCT/US12/40156, 7 pages.

International Preliminary Report on Patentability of corresponding application PCT/US2012/040156, mailed Dec. 12, 2013, 6 pages.

* cited by examiner

ELECTRONIC TIMER/SENSOR TO PROTECT SKIN FROM OVEREXPOSURE TO UV RADIATION

Radiation from the sun can cause damage to a human being's health. Products containing sunscreen agents have been developed to help protect a human being's skin. Before being exposed to solar radiation, a user applies a sunscreen product to his or her skin.

After a certain amount of time, the sunscreen agent in the product becomes less effective or noneffective and must be reapplied. Moreover, because sunscreen tends to be rubbed or washed off with sweating and water exposure, it needs to be reapplied. Because people can lose track of time while they are enjoying the outdoors, the sunscreen product may not be reapplied as necessitated thus compromising the protection afforded in the first place. This is especially true for children. The embodiments of the present invention provide a portable device that can be worn by a user or attached to an object kept in the company of the user that alerts the user when it is time to reapply a sunscreen product. The device is simple to use and can be used by a child, for example.

DETAILED DESCRIPTION OF THE DRAWINGS

Figure 1:
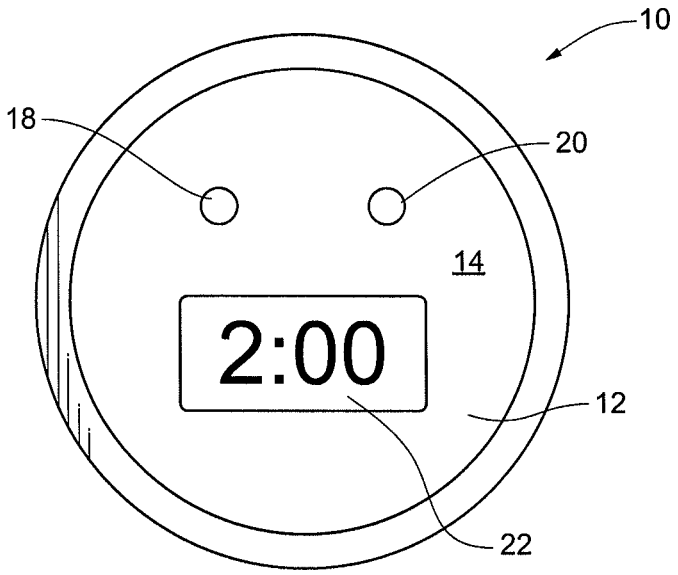
FIG. 1 is a front view of a portable device according to a preferred embodiment of the invention.

FIG. 1 is a front view of a portable device according to a preferred embodiment of the invention. The device 10 has a housing 12 that has a front surface 14 and a rear surface 16 (See FIGS. 2 and 3). On the front surface 14 of the device 10 is a start/stop button 18, a reset button 20 and a window 22. Located within the housing 12 is a timer (not shown). The operation of the device will be described hereinafter.

Preferable the housing is made of a plastic and may or may not have of a UV sensitive plastic coating. For example, it may be a colorless plastic that will change colors depending on the detection and/or exposure level of UV light. For example, it may start off a pale shade of color and increase the intensity of that color as the exposure to UV light continues. In addition, it may start off in a cool color such as blue when first exposed to UV light and may change to warmer colors like pink, orange and red as the exposure increases.

Figure 2:
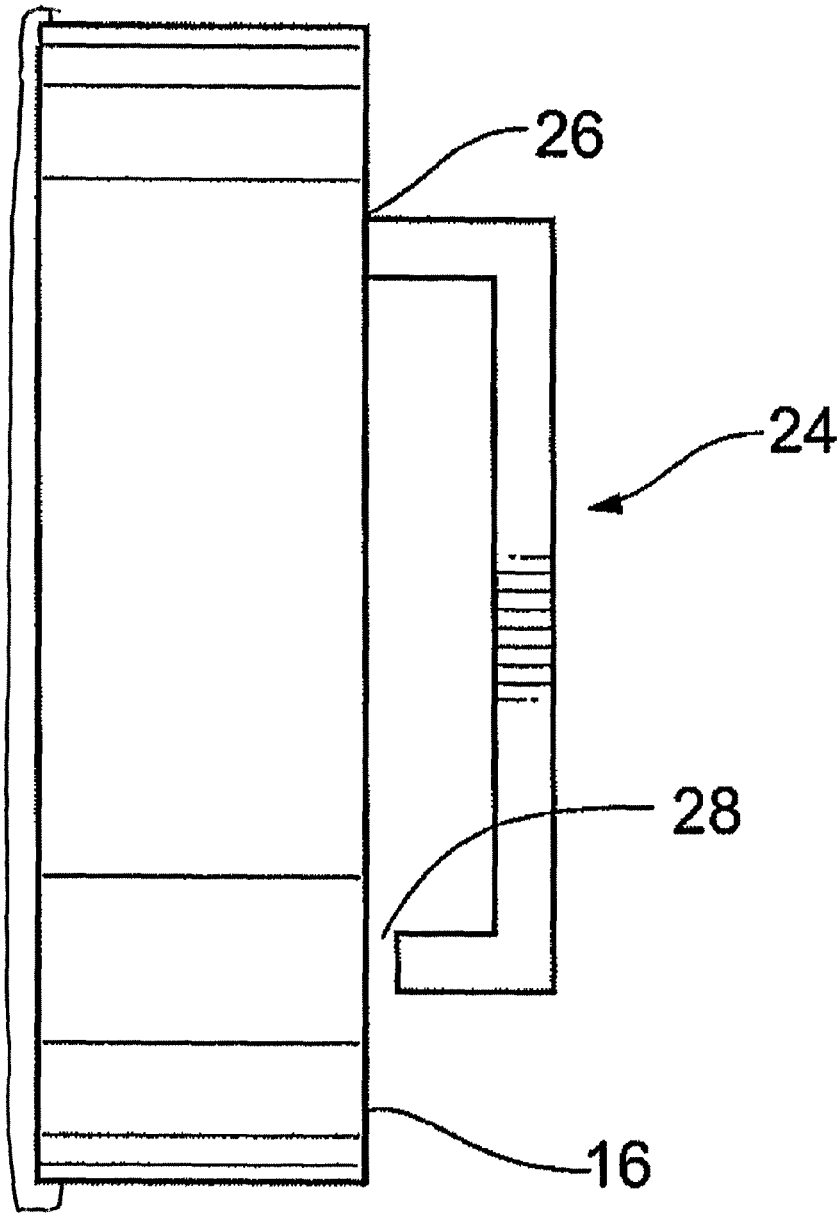
FIG. 2 is a side view of the device shown in FIG. 1.
Figure 3:
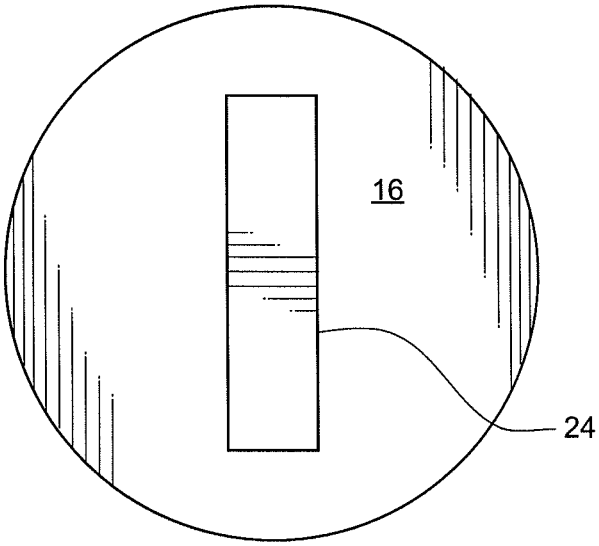
FIG. 3 is a rear view of the device shown in FIG. 1.

FIG. 2 is a side view of the device shown in FIG. 1 and FIG. 3 is a rear view thereof.

Provided on the rear surface 16 of the housing 12 is a clip 24. The clip 24 may simply be a passive device such as plastic arm that is coupled to the rear surface 16 of the housing 12 at one end 26 and left uncoupled at its opposite end 28. To fasten the housing to an object (not shown) the clip 24 shown in FIG. 2 has its end 28 slid over a portion of the object so that the portion of the object is sandwiched between the rear surface 16 of the housing 12 and an interior surface of the clip 24. Alternatively, the clip 24 may be an active device that is pivotally hinged at end 26 to the rear surface 16 of the housing by a well known spring-type clip that biases the clip to a closed position as shown. To fasten the housing to an object (not shown) the end 26 of the clip is pressed to overcome the spring bias so that its opposite end 28 is moved further away from the rear surface 16 of the housing 12 so that a portion of the object can be sandwiched between the rear surface 16 of the housing 12 and an interior surface of the clip 24. The user then releases pressure on end 26 of the clip 24 so that the spring closes the clip so that the gap between end 28 and rear surface 16 is eliminated.

Figure 4:
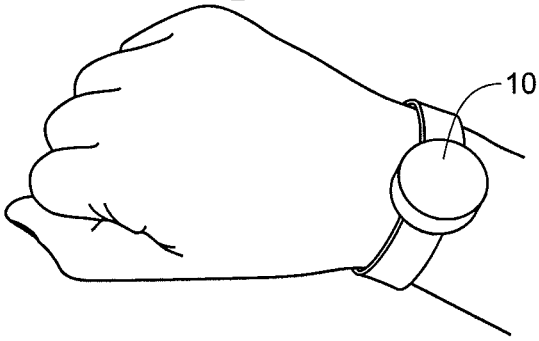
FIGS. 4-9 are front views of the device attached to a myriad of objects.
Figure 5:
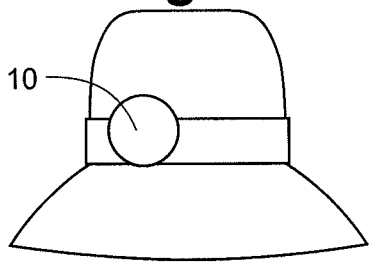
Figure 6:
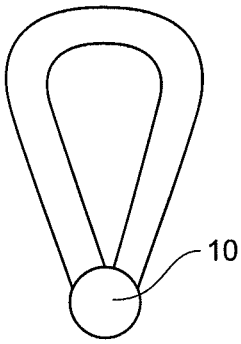
Figure 7:
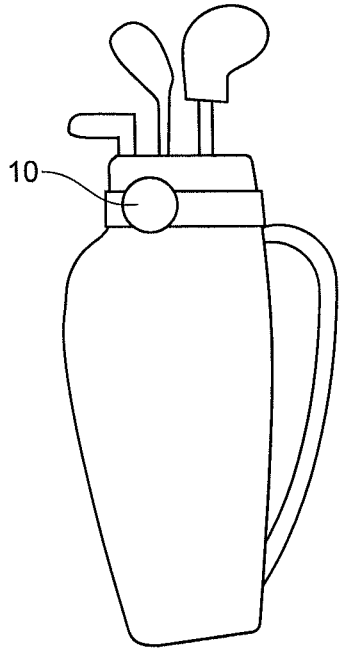
Figure 8:
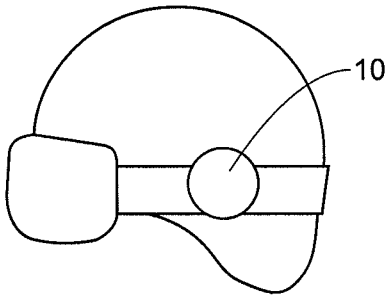
Figure 9:
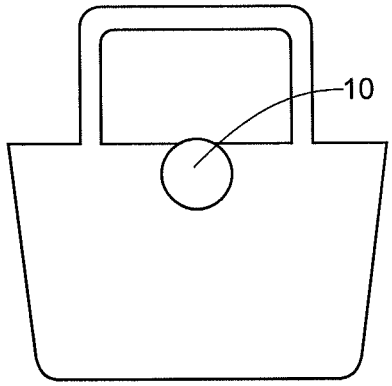

FIGS. 4-9 illustrate various objects onto which the device 10 may be attached. In FIG. 4, the device 10 may be attached to a wristband to be worn like a watch. In a preferred embodiment the housing may be made waterproof or substantially waterproof to withstand the elements. In FIG. 5, the device 10 is attached to a hat, in FIG. 6, the device 10 is attached to a lanyard, in FIG. 7, the device 10 is attached to a golf bag, in FIG. 8, the device 10 is attached to goggles that can be used with a ski helmet or scuba gear, for example, and in FIG. 9, the device 10 is attached to a bag such as a beach bag.

In operation, a user applies a sunscreen product to the user's skin and the user attaches the device 10 to an object either the user plans to wear or an object that will be present close-by to the user when she is outdoors. The user depresses the start/stop button 18 to initiate the timer located in the housing. By initiating the timer, a fixed amount of time is loaded on the timer and the timer counts down from this fixed amount of time. The fixed amount of time can range from about 1 to about 4 hours but more preferably is about 2 hours and most preferably is exactly 2 hours. Various scientific data indicate that, preferably, sunscreen should be reapplied every two hours. See, for example, aad.org/media-resources/stats-and-facts/prevention-and-care/sunscreens; skincancer.org/the-scfs-guide-to-sunscreens.html; msnbc.msn.com/id/28796417/ns/health-skinandbeauty. The fixed amount of time through the window 22 on the front surface 14 of the device. The timer counts down from the fixed amount of time to zero. Through the window 22 the user can see the remaining time left. Upon the timer reaching zero, an indicator is activated to notify the user that the fixed amount of time has passed and it is time to reapply the sunscreen product. In an embodiment, the indicator may be a visual, audible or vibrational, alarm, for example, or it may be a combination of alarms. Once the user has reapplied the sunscreen product, she can depress the reset button and then depress the start button. The start/stop button may be used to stop the timer when, for example, the user goes inside away from the solar radiation. When the user is exposed to solar radiation again, she can depress the start/stop button and the timer will continue from where it left off.

In another embodiment, the device 10 may be provided with a cover over its front surface to prevent inadvertent depression of the start/stop and reset buttons 18, 20 respectively. The cover may be a hard plastic that is pivotally coupled to the device and thus the user can pivot the cover so that the start/stop and reset button are exposed. After the user has made a selection and activated a button, the plastic cover may be pivoted so that it covers the front surface of the device. Alternatively, a flexible gel-type cover may be placed over the front surface of the device which makes it more difficult for an inadvertent depression of the buttons to occur.

A benefit of the embodiments of the invention is that it is so simple to use a child as young as 5 years old may use it and can let her parent know when it is time to reapply the sunscreen product.

What is claimed is:

1. A portable device for indicating when a user should reapply a sunscreen product comprising:

a substantially waterproof housing having a front surface and a rear surface;

a clip located on the rear surface of the housing for attaching the housing to an object;

a timer located within the housing, the timer pre-loaded with a fixed, pre-set amount of time corresponding to a recommended amount of time to reapply a sunscreen product; and a start button located on the front surface of the housing wherein when the start button is depressed, the timer counts down from the fixed, pre-set amount of time to zero whereupon, when zero is reached, an indicator is activated to notify the user that the fixed, pre-set amount of time has elapsed and it is time to reapply the sunscreen product; and wherein the housing is made of a UV sensitive plastic coating, and wherein the UV sensitive plastic coating changes color proportional to exposure to sunlight over the duration of the pre-set amount of time.

2. The device of claim 1 further comprising a reset button located on the front surface of the housing whereupon the expiry of the fixed, pre-set amount of time, the reset button can be depressed to reset the timer with the fixed, pre-set amount of time.

3. The device of claim 1 further comprising a cover placeable over the front surface of the housing, the cover preventing inadvertent depression of the start button.

4. The device of claim 1 wherein the indicator is selected from the group of an audible alarm, a visual alarm, a combination of an audible and visual alarm.

5. The device of claim 1 further comprising a window located on the front surface indicating time remaining on the timer from the fixed, pre-set amount of time.

6. The device of claim 1 wherein the fixed, pre-set amount of time can range from about 1 hour to about 4 hours.

7. The device of claim 1 wherein the fixed, pre-set amount of time is about 2 hours.

8. The device of claim 1 wherein the clip can be used to attach the housing to any one of the selected group of a wristband, sunglasses, hat, clothing, golf club bag, bicycle.

9. A portable device for indicating when a user should reapply a sunscreen product consisting essentially of:

a substantially waterproof housing having a front surface and a rear surface;

a clip located on the rear surface of the housing for attaching the housing to an object;

a timer located within the housing, the timer having a fixed, pre-set amount of time corresponding to a recommended amount of time to reapply a sunscreen product; and a start button located on the front surface of the housing wherein when the start button is depressed, the timer counts down from the fixed pre-set amount of time to zero whereupon when zero is reached, an indicator is activated to notify the user that the fixed, pre-set amount of time has elapsed and it is time to reapply the sunscreen product; and wherein the housing is made of a UV sensitive plastic coating, and wherein the UV sensitive plastic coating changes color proportional to exposure to sunlight over the duration of the pre-set amount of time.

10. The device of claim 9 further comprising a reset button located on the front surface of the housing whereupon the expiry of the fixed, pre-set amount of time, the reset button can be depressed to reset the timer with the fixed, pre-set amount of time.

11. The device of claim 9 further comprising a cover placeable over the front surface of the housing, the cover preventing inadvertent depression of the start button.

12. The device of claim 9 wherein the indicator is selected from the group of an audible alarm, a visual alarm, a combination of an audible and visual alarm.

13. The device of claim 9 further comprising a window located on the front surface indicating time remaining on the timer from the fixed, pre-set amount of time.

14. The device of claim 9 wherein the fixed, pre-set amount of time can range from about 1 hour to about 4 hours.

15. The device of claim 9 wherein the fixed, pre-set amount of time is about 2 hours.

16. The device of claim 9 wherein the clip can be used to attach the housing to any one of the selected group of a wristband, sunglasses, hat, clothing, golf club bag, bicycle.

17. A portable device for indicating when a user should reapply a sunscreen product comprising:

a substantially waterproof housing having a front surface and a rear surface;

attachment means located on the rear surface of the housing for attaching the housing to an object;

a timer located within the housing, the timer having a fixed, pre-set amount of time corresponding to a recommended amount of time to reapply a sunscreen product; and a start button located on the front surface of the housing wherein when the start button is depressed, the timer counts down from the fixed, pre-set amount of time to zero whereupon when zero is reached, an indicator is activated to notify the user that the fixed, pre-set amount of time has elapsed and it is time to reapply the sunscreen product; and wherein the housing is made of a UV sensitive plastic coating, and wherein the UV sensitive plastic coating changes color proportional to exposure to sunlight over the duration of the pre-set amount of time.

18. The device of claim 17 wherein the indicator is selected from the group of an audible alarm, a visual alarm, a combination of an audible and visual alarm.

19. The device of claim 17 wherein the fixed, pre-set amount of time is about 2 hours.

* * * * *